US010349678B2

(12) United States Patent
Chen

(10) Patent No.: US 10,349,678 B2
(45) Date of Patent: Jul. 16, 2019

(54) ELECTRONIC CIGARETTE, ATOMIZER DEVICE THEREOF, METHOD FOR ASSEMBLING THE ATOMIZER DEVICE

(71) Applicant: Shenzhen Smoore Technology Limited, Shenzhen, Guangdong (CN)

(72) Inventor: Zhiping Chen, Guangdong (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 5 days.

(21) Appl. No.: 15/551,607

(22) PCT Filed: Jun. 30, 2015

(86) PCT No.: PCT/CN2015/082862
§ 371 (c)(1),
(2) Date: Aug. 17, 2017

(87) PCT Pub. No.: WO2017/000239
PCT Pub. Date: Jan. 5, 2017

(65) Prior Publication Data

US 2018/0027881 A1 Feb. 1, 2018

(51) Int. Cl.

| | |
|---|---|
| ***A24F 13/00*** | (2006.01) |
| ***A24F 47/00*** | (2006.01) |
| ***F22B 1/28*** | (2006.01) |
| ***H05B 3/44*** | (2006.01) |

(52) U.S. Cl.
CPC ..... *A24F 47/008* (2013.01); *F22B 1/284* (2013.01); *H05B 3/44* (2013.01)

(58) Field of Classification Search
CPC ..... A24F 47/00
USPC ..... 131/328–329
See application file for complete search history.

(56) References Cited

U.S. PATENT DOCUMENTS

| | | | | |
|---|---|---|---|---|
| 9,861,132 | B2 * | 1/2018 | Li | A24F 47/008 |
| 2016/0016153 | A1 * | 1/2016 | Dubois | B01J 37/04 558/313 |
| 2016/0135505 | A1 * | 5/2016 | Li | H05B 3/44 131/329 |

* cited by examiner

*Primary Examiner* — Phuong K Dinh
(74) *Attorney, Agent, or Firm* — Hemisphere Law, PLLC; Zhigang Ma

(57) ABSTRACT

An electronic cigarette, an atomizer device thereof and a method for assembling the atomizer device are provided. The atomizer device comprises an atomizer assembly (14) having an atomizer base (141), a heating member (142), and a liquid conductive member (143). The atomizer base (141) includes a cylindrical body (1412) having an inserting end (1413); and a side wall of the cylindrical body (1412) defines at least one slot (1414) extending along a vertical direction and communicating with an end surface of the inserting end (1413). The heating member (142) is cylindrical and arranged in the cylindrical body (1412), and an air flowing channel is defined inside the heating member (142). The liquid conductive member (143) comprises a cylindrical liquid conductive body (1431) and at least one couple of connecting portions (1432) connected together in a circumferential direction of the liquid conductive body (1431).

18 Claims, 7 Drawing Sheets

ELECTRONIC CIGARETTE, ATOMIZER DEVICE THEREOF, METHOD FOR ASSEMBLING THE ATOMIZER DEVICE

TECHNICAL FIELD

The present disclosure relates to substitutes for cigarettes, and more particularly, to an electronic cigarette, an atomizer device thereof, and a method for assembling the atomizer device.

BACKGROUND

At present, during an assembly process of an atomizer of an electronic cigarette, liquid conductive cotton is twined around a heating coil and the heating coil with the liquid guiding cotton is inserted into an atomizer base. However, this type of atomizer coil increases the assembly complexity of the atomizer. In addition, the liquid conductive cotton twined around the heating coil cannot contact the liquid solution outside the atomizer coil, which causes a poor performance of the liquid conductive cotton in conducting liquid.

SUMMARY OF THE DISCLOSURE

An improved electronic cigarette, an atomizer device thereof, and a method for assembling the atomizer device are provided in the present disclosure.

The atomizer device provided in the present disclosure includes an atomizer assembly having an atomizer base, a heating member, and a liquid conductive member; the atomizer base includes a cylindrical body having an inserting end; and a side wall of the cylindrical body defines at least one slot extending along a vertical direction and communicating with an end surface of the inserting end; the heating member is cylindrical and arranged in the cylindrical body along an axial direction of the cylindrical body, and an air flowing channel is defined inside the heating member; the liquid conductive member includes a cylindrical liquid conductive body and at least one couple of connecting portions connected together in a circumferential direction of the liquid conductive body; and the liquid conductive body surrounds the heating member, and at least one of the connecting portion of each couple extends out of the cylindrical body through the corresponding slot.

Preferably, the connecting portions of each couple extend out of the cylindrical body through the corresponding slot.

Preferably, the cylindrical body defines two of the slots, and the two slots are symmetrically arranged along a circumferential direction of the cylindrical body.

Preferably, the liquid conductive member includes two liquid conductive pieces; each of the liquid conductive pieces includes an arch body and two connecting portions extending outwards from two circumferential sides of the arch body; the arch bodies of the two liquid conductive pieces are connected to form the liquid conductive body; and two adjacent connecting portions of the two liquid conductive pieces are connected to form two couples of the connecting portions corresponding to the slots respectively.

Preferably, the atomizer device further includes an atomizer cover and a cartridge; the atomizer cover includes a cylindrical tube; a liquid reservoir chamber is formed in the cartridge; the cylindrical tube defines at least one liquid inlet communicating with the liquid reservoir chamber, and the atomizer assembly is arranged in the cylindrical tube such that the liquid conductive member can absorb liquid solution flowing into the cylindrical body through the liquid inlet.

Preferably, the atomizer assembly is arranged inside the cylindrical tube along an axial direction of the cylindrical tube; a liquid stopper is arranged between the cylindrical tube and the cylindrical body for reducing a flowing speed of the liquid solution flowing to the slot through the liquid inlet.

Preferably, the liquid stopper is cylindrical and surrounds the cylindrical body, the cylindrical tube defines a plurality of the liquid inlets, and the liquid inlets are arranged along a circumferential direction of the cylindrical tube.

Preferably, a guiding portion is arranged between the slot and the inserting end for guiding the connecting portion to be inserted into the slot.

Preferably, the guiding portion includes a chamfered fillet or a chamfered bevel.

Preferably, a guiding surface is defined in an inner ring of the inserting end for guiding an insertion of the liquid conductive body.

Preferably, the heating member includes a spiral cylindrical heating coil or a cylindrical heating tube.

Preferably, the cartridge includes an outer tube and an inner tube, and the liquid reservoir chamber is formed between the inner tube and the outer tube; the atomizer cover further includes an embedded tube arranged on one end of the cylindrical tube and inserted into an inner hole of the inner tube; and the embedded tube communicates with the inner tube, and an outer wall of the embedded tube is provided with engaging teeth or engaging threads for engaging with an inner wall of the embedded tube.

The electronic cigarette provided in the present disclosure includes the above atomizer device.

The method for assembling the above atomizer device in accordance with an embodiment of the present disclosure includes:

step A, providing at least one sheet of liquid conductive material, wherein each sheet of the liquid conductive material includes a surrounding portion surrounding the heating member and two extending portions extending from two opposite sides of the surrounding portion respectively;

surrounding the surrounding portion around the heating member such that the surrounding portion forms the liquid conductive body surrounding a circumference of the heating member and the extending portions contact each other at a connecting position of the surrounding portion and extend outwards;

step B, inserting the heating member and the liquid conductive body into the cylindrical body along an axial direction of the cylindrical body through the inserting end, and inserting the extending portions into the corresponding slot such that the extending portions extend out of the slot; and step C, cutting a portion of each extending portion extending out of the slot, such that a remaining portion of the extending portion which is connected to the surrounding portion and inserted in the slot forms the connecting portion, allowing the liquid conductive member to be formed by the at least one sheet of the liquid conductive material.

The method for assembling of the above atomizer device in accordance with another embodiment includes:

step A, providing at least two sheets of liquid conductive material, wherein each sheet of the liquid conductive material includes a surrounding portion surrounding the heating member and two extending portions extending from two opposite sides of the surrounding portion respectively;

clamping the surrounding portions of the at least two sheets of liquid conductive material on a side wall of the heating member such that the extending portion extend outwards along a lateral direction of the heating member;

surrounding each of the surrounding portions around the heating member such that each of the surrounding portion is curved to form an arch body and the arch bodies are circumferentially connected to form the liquid conductive body to clamp the heating member, and each of the extending portions contacts the corresponding extending portion of the other sheet of liquid conductive material respectively to keep clamping the heating member;

step B, holding the extending portions and inserting the liquid conductive body into the cylindrical body through the inserting end such that the extending portions are respectively inserted into the slots; and step C, cutting a portion of each extending portion extending out of the slot, such that a remaining portion of the extending portion which is connected to the surrounding portion and inserted in the slot forms the connecting portion, allowing the liquid conductive member to be formed by the at least two sheets of the liquid conductive materials.

In the present disclosure, the liquid conductive member has the connecting portion extending outwards at the circumferential connecting position, thus, the liquid conductive member can absorb the liquid solution outside the cylindrical body by the connecting portion, thus, the liquid conductive performance of the electronic cigarette can be improved. Meanwhile, the liquid conductive member can be inserted into the cylindrical body by the liquid conductive body formed by surrounding the liquid conductive material around the heating member; and after the extending portion is clamped into the slot, a portion of the extending portion extending out of the slot is cut to form the connecting portion, thus, the assembly of the liquid conductive member is facilitated and the assembly efficiency the atomizer device is improved. In addition, requirements for good liquid conductive performance of the atomizer device can be satisfied.

BRIEF DESCRIPTION OF THE DRAWINGS

The present disclosure will be described in more detail with reference to the accompany drawings and the embodiments, wherein in the drawings.

PREFERRED EMBODIMENTS

For clearly understanding technical features, purpose, and effect of the present disclosure, embodiments are given in detail hereinafter with reference to the accompanying drawings.

Figure 1:
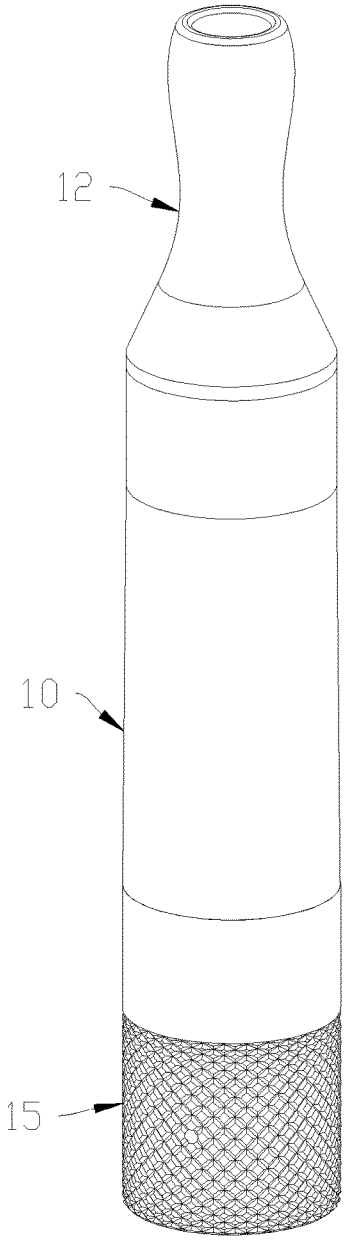
FIG. 1 is a schematic view of an atomizer device of an electronic cigarette in accordance with an embodiment of the present disclosure.
Figure 2:
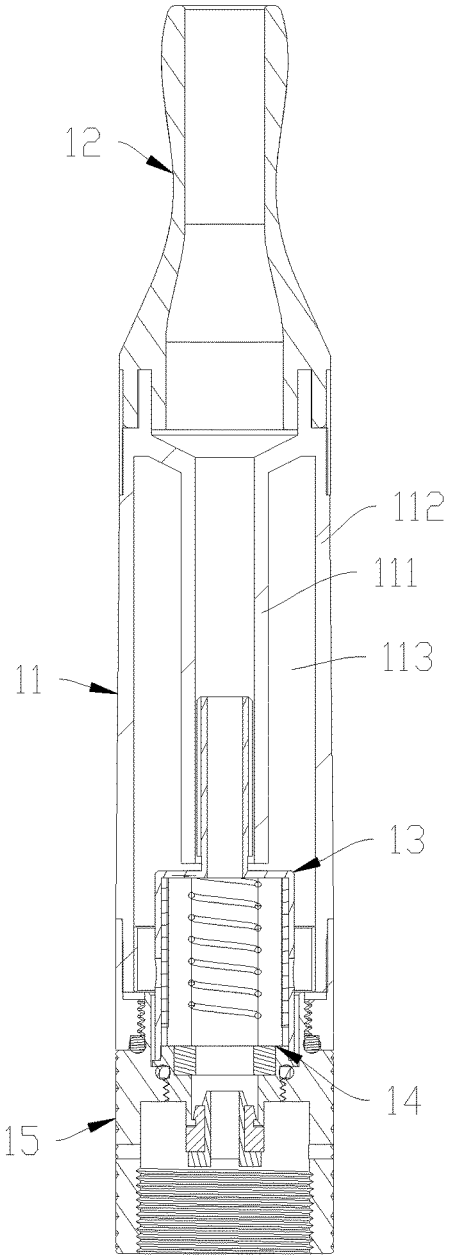
FIG. 2 is a cross-sectional view of the atomizer device of FIG. 1.
Figure 3:
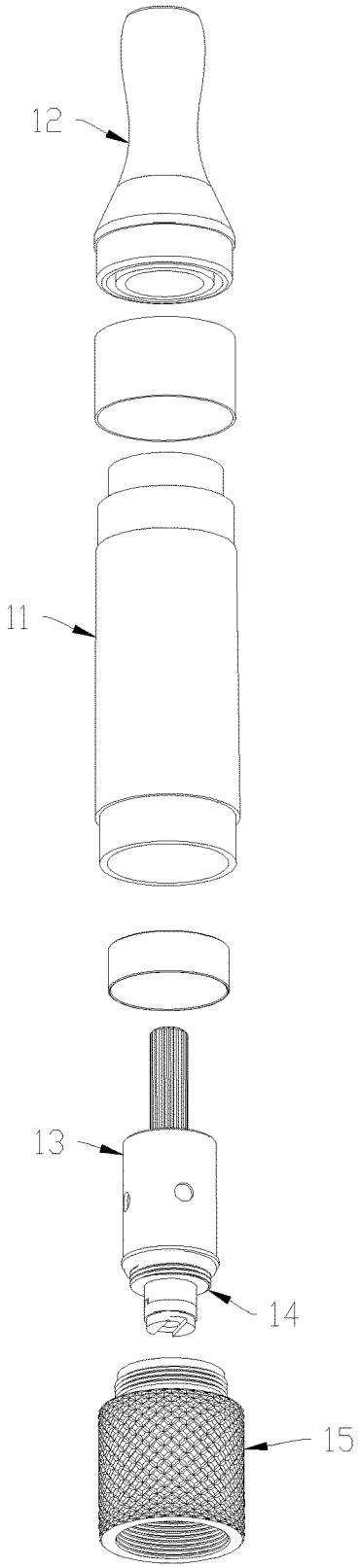
FIG. 3 is an exploded view of the atomizer device of FIG. 1.
Figure 4:
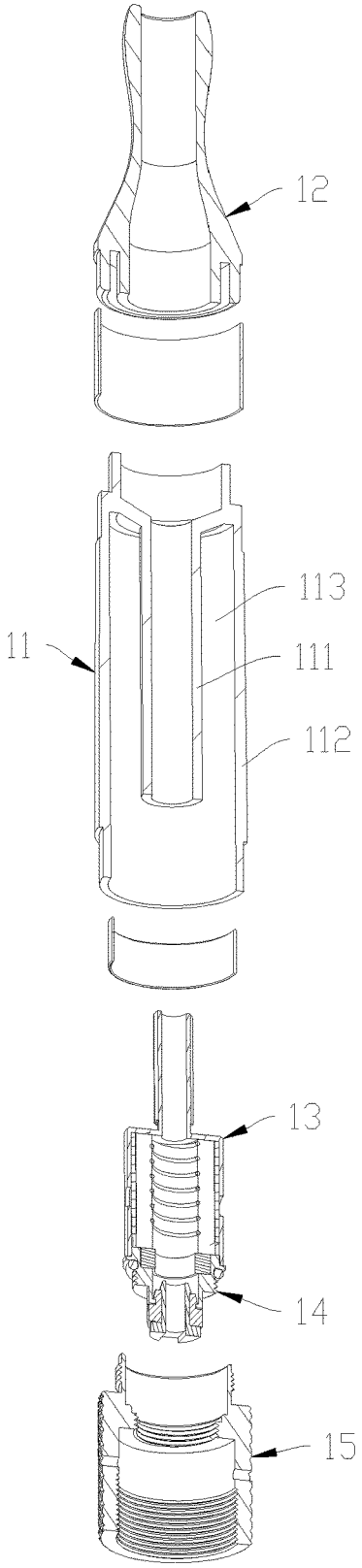
FIG. 4 is a cross-sectional view of the atomizer device of FIG. 3.

Referring to FIGS. 1 and 2, an electronic cigarette in accordance with an embodiment of the present disclosure includes an atomizer device 10 and a battery device. The atomizer device 10 includes a cartridge 11, a suction nozzle 12, an atomizer cover 13, an atomizer assembly 14, and a connection member 15. The suction nozzle 12 and the atomizer assembly 14 are respectively arranged on two opposite ends of the cartridge 11. The battery device is connected to the connection member 15 for supplying power to heat and atomize liquid solution of the electronic cigarette.

In some embodiments, the cartridge 11 includes an inner tube 111 and an outer tube 112. A liquid reservoir chamber 113 is formed between the inner tube 111 and the outer tube 112 for containing the liquid solution. The suction nozzle 12 is mounted on one end of the cartridge 11 for covering one end of the liquid reservoir chamber 113. An air outlet of the suction nozzle 12 communicates with the inner tube 111.

Referring to FIGS. 2 to 5, the atomizer cover 13 is arranged on one end of the inner tube 111 corresponding to the suction nozzle 12. The atomizer cover 13 includes a cylindrical tube 131 and an embedded tube 132. The embedded tube 132 is arranged on one end of the cylindrical tube 131, being inserted into an inner hole of the inner tube 111 and communicating with the inner tube 111. An outer wall of the embedded tube 132 is provided with engaging teeth or engaging threads for engaging with an inner wall of the inner tube 111. After the embedded tube 132 is mounted to the inner tube 111, the positioning of the atomizer cover 13 and the inner tube 111 in the circumferential direction is enabled.

At least one liquid inlet 1311 is defined in a side wall of the cylindrical tube 131. In some embodiments, a number of the liquid inlets 1311 may be defined in the outer wall of the cylindrical tube 131, and the liquid inlets 1311 are arranged along a circumference of the cylindrical tube 131 such that the liquid solution can evenly flow into the cylindrical tube 131 through the liquid inlets 1311. The atomizer assembly 14 is arranged inside the cylindrical tube 131, thus, a liquid conductive member 143 is capable of absorbing the liquid solution flowing into the cylindrical tube 131 through the liquid inlets 1311.

Figure 5:
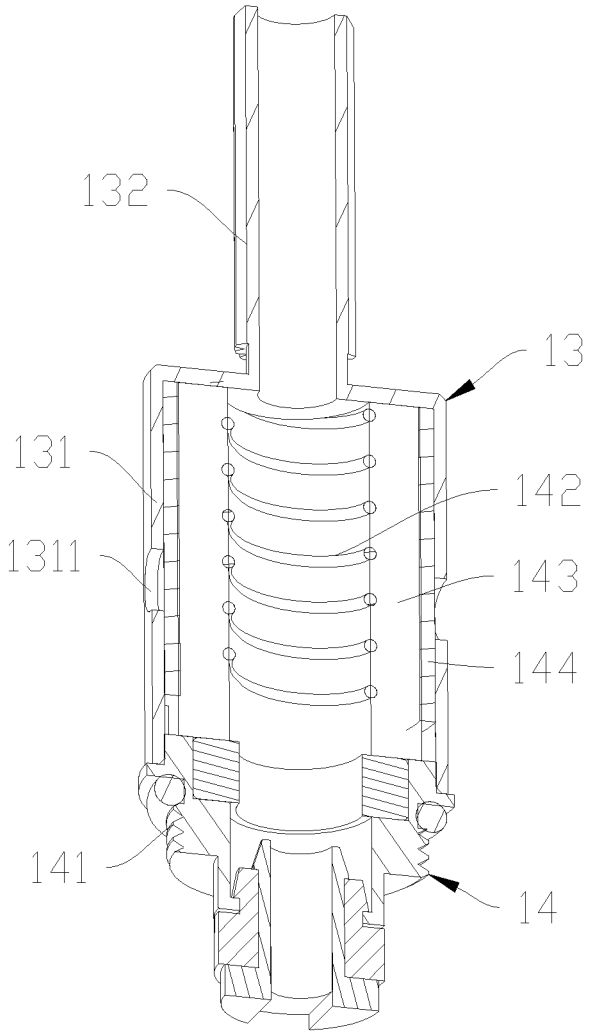
FIG. 5 is a cross-sectional view of an atomizer cover and an atomizer assembly of FIG. 3 wherein the atomizer cover and the atomizer assembly are in an assembled state.
Figure 6:
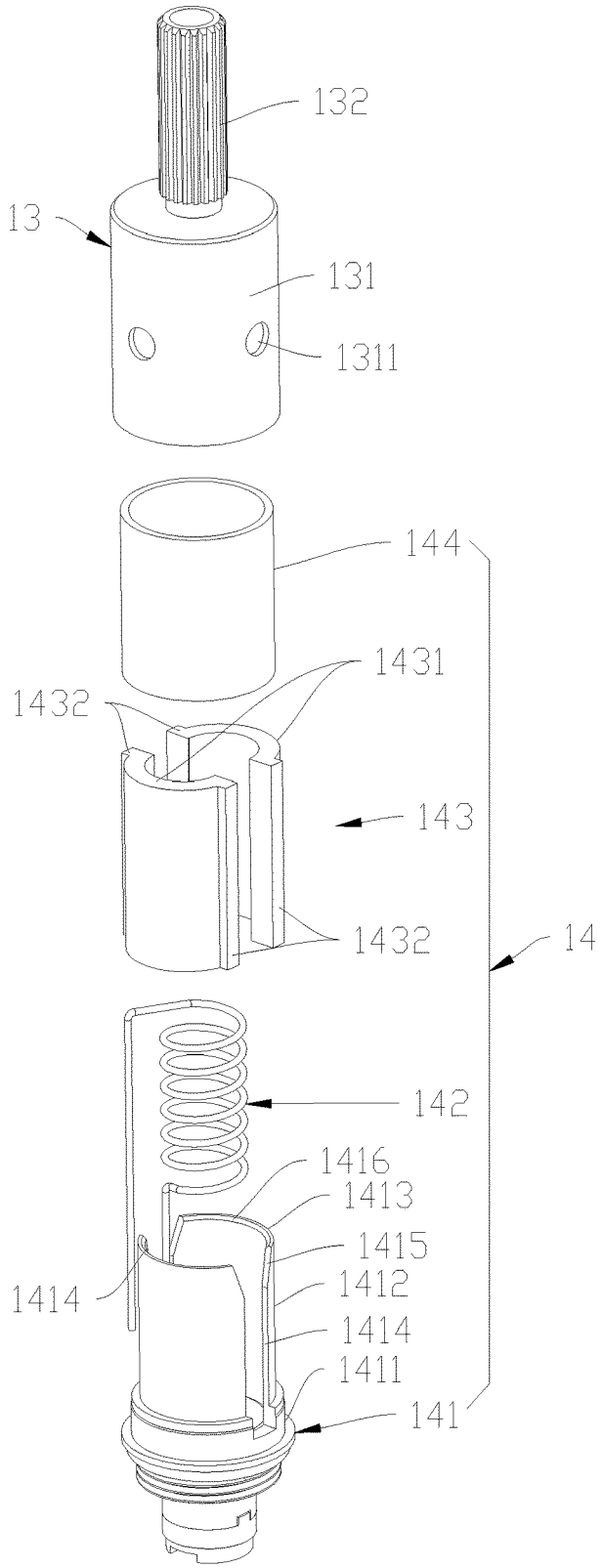
FIG. 6 is a schematic view of the atomizer cover and the atomizer assembly of FIG. 3 wherein the atomizer cover and the atomizer assembly are in a disassembled state.

Referring to FIGS. 5 and 6, in some embodiments, the atomizer assembly 14 includes an atomizer base 141, a heating member 142, and the liquid conductive member 143. The atomizer base 141 includes an annular supporting base 1411 and a cylindrical body 1412 arranged on one side of the supporting base 1411. The cylindrical body 1412 includes an inserting end 1413 corresponding to the supporting base 1411. Two slots 1414 are defined in a side wall of the cylindrical body 1412. The slots 1414 extend along an axial direction of the cylindrical body 1412 and communicate with an end surface of the inserting end 1413. In the embodiment, the slots 1414 extend along the axial direction of the cylindrical body 1412 to facilitate the insertion of the liquid conductive member 143; in other embodiments, the slots 1414 may not extend along the axial direction of the cylindrical body 1412. The slots 1414 are symmetrically arranged long a circumferential direction of the cylindrical body 1412, such that the liquid conductive member 143 is inserted into the slots 1414 without the need of distinguishing the rotation direction.

The heating member 142 is cylindrical and is arranged in the cylindrical body 1412 along the axial direction of the cylindrical body 1412. In some embodiments, the heating member 142 includes a spiral cylindrical heating coil or a cylindrical heating tube. An air flowing channel is defined inside the heating member 142, allowing the atomized liquid solution to flow to the suction nozzle 12 through the embedded tube 132.

The liquid conductive member 143 includes a cylindrical liquid conductive body 1431 and two couples of connecting portions 1432. The liquid conductive body 1431 surrounds the heating member 142. Each couple of connecting portions 1432 extend out of the cylindrical body 1412 through the corresponding slot 1414, such that the liquid conductive member 143 can absorb the liquid solution outside the cylindrical body 1412. In other embodiments, the liquid conductive member 143 can be configured in a way that one connecting portion of each couple extends out of the cylindrical body 1412 through the corresponding slot 1414 and the other connecting portion does not extend out of the cylindrical body 1412 through the corresponding slot 1414.

The liquid conductive member 143 includes two liquid conductive pieces. Each of the liquid conductive pieces includes an arch body and two of the connecting portions 1432 extending outwards from two circumferential sides of the arch body along two opposite directions respectively. After the two liquid conductive pieces are jointly connected together, the two arch bodies of the two liquid conductive pieces are connected together to form the liquid conductive body 1431, and each connecting portion 1432 of one liquid conductive piece is connected to the corresponding connecting portion 1432 of the other liquid conductive piece to form a couple of the connecting portions 1432 corresponding to one of the slots 1414.

In other embodiments, the liquid conductive member 143 may be formed by one single component which includes the liquid conductive body 1431 and a couple of the connecting portions 1432. The connecting portions 1432 can be connected together circumferentially and extend out of the cylindrical body 1412 to absorb the liquid solution through the corresponding slot 1414. In other embodiments, the liquid conductive member 143 may include more than two liquid conductive pieces, and the two liquid conductive pieces may form more than two couples of connecting portions 1432; the number of the slots 1414 is accordingly more than two such that the more than two couples of the connecting portions 1432 may extend outwards through the more than two slots 1414, respectively.

The atomizer base 141 further includes a guiding portion 1415 arranged between each slot 1414 and the inserting end 1413. The guiding portion 1415 is configured to guide the connecting portion 1432 to be inserted into the slot 1414 when the liquid conductive member 143 is inserted into the cylindrical body 1412. In some embodiments, the guiding portion 1415 may be a chamfered fillet or a chamfered bevel. A circle of guiding surface is defined in the inner ring of the inserting end 1413. The guiding surface is adjacent to the end surface of the inserting end 1413 for guiding the insertion of the liquid conductive body 1431. In some embodiments, the guiding surface is an inclined surface.

In some embodiments, the atomizer assembly 14 is arranged in the cylindrical tube 131 along an axial direction of the cylindrical tube 131, and the supporting base 1411 is located on one end of the cylindrical tube 131 corresponding to the embedded tube 132, thus, the supporting base 1411 abuts the heating member 142 and the liquid conductive member 143 against an inner surface of one end of the atomizer cover 13 corresponding to the embedded tube 132. The liquid solution flows to the connecting portions 1432 at the slots 1414 through the liquid inlet 1311 to be absorbed by the liquid conductive member 143. The atomizer assembly 14 further includes a liquid stopper 144 arranged between the cylindrical tube 131 and the cylindrical body 1412 for reducing the flowing speed of the liquid solution flowing to the slots 1414. The liquid stopper 144 is cylindrical and is sleeved on the cylindrical body 1412. The liquid stopper 144 is generally made of liquid conductive sponge which is capable of absorbing the liquid solution and reducing the flowing speed of the liquid solution flowing to the slots 1414.

The connection member 15 is arranged on one end of the cartridge 15 corresponding to the suction nozzle 12. The connection member 15 engages with the supporting base 1411 of the atomizer base 141 and the outer tube 112 of the cartridge 11, thereby sealing the corresponding end of the liquid reservoir chamber 113.

Figure 7:
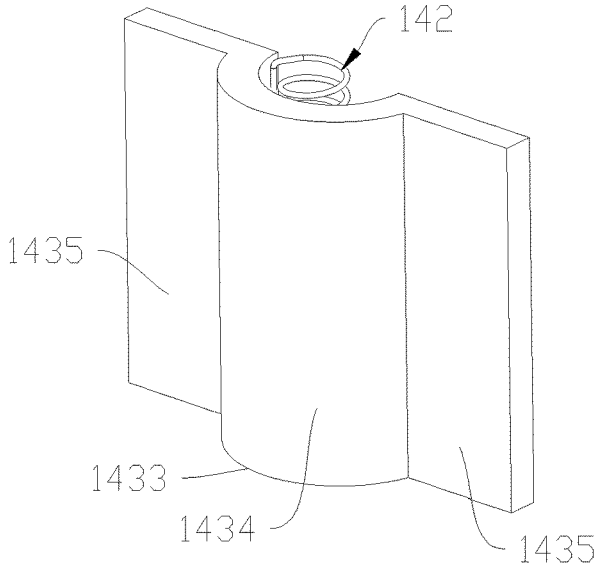
FIG. 7 is a schematic view showing that a sheet of liquid conductive material surrounds a heating member.
Figure 8:
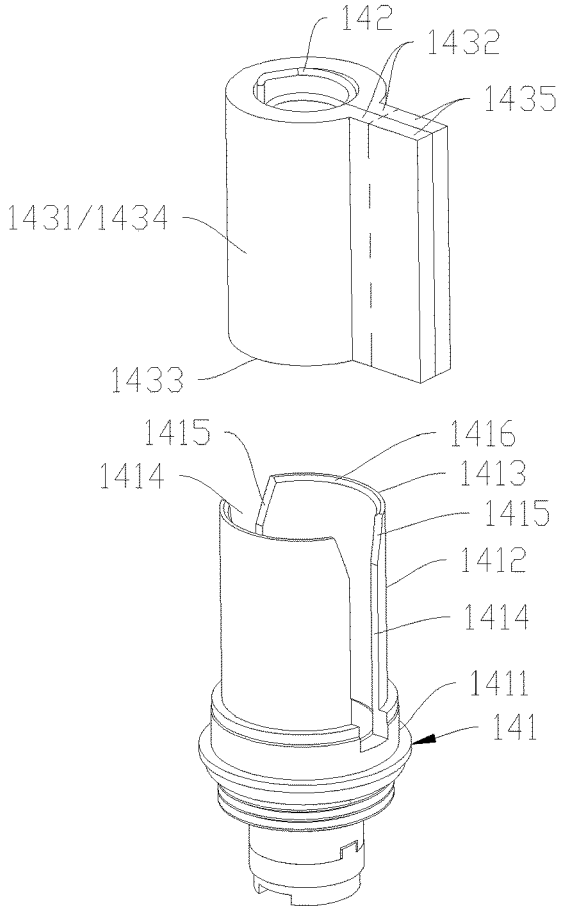
FIG. 8 is a schematic view showing that the sheet of liquid conductive material surrounding the heating member of FIG. 7 is inserted into the atomizer base.

Referring to FIGS. 6 to 8, since the connecting portion 1432 is relatively small, the liquid conductive member 143 may be easily deformed when being inserted into the corresponding slot 1414, the liquid conductive member 143 may not be easily positioned. In the embodiment, during the assembly process of the atomizer device, the liquid conductive member 143 is formed by processing the liquid conductive material 1433 after the liquid conductive material 1433 surrounding the heating member 142 are inserted into the cylindrical body 1412.

In embodiments that the liquid conductive member 143 is made of one sheet of liquid conductive material 1433, the method for assembling the atomizer assembly 14 includes steps as follows.

Step A, providing a sheet of liquid conductive material 1433, wherein the sheet of liquid conductive material 1433 includes a surrounding portion 1434 surrounding the heating member 142 and two extending portions 1435 extending from two opposite sides of the surrounding portion 1434 respectively; and surrounding the surrounding portion 1434 around the heating member 142 such that the surrounding portion 1434 forms the liquid conductive body 1431 surrounding a circumference of the heating member 142 and the extending portions 1435 contact each other at the connecting position of the surrounding portion 1434 and extend outwards to be inserted into the cylindrical body 1412 to engage with the corresponding slot 1414. In some embodiments, the liquid conductive material 1433 can be liquid conductive sponge, and the extending portion 1435 can be connected to the surrounding portion 1434, or the extending portion 1435 can be formed by being bent towards one side of the surrounding portion 1434.

Step B, inserting the heating member 142 and the liquid conductive body 1431 into the cylindrical body 1412 along the axial direction of the cylindrical body 1412 through the inserting end 1413, and inserting the two extending portions 1435 into the corresponding slot 1414 such that the extending portions 1435 partially extend out of the slot 1414.

Step C, cutting a portion of each extending portion 1435 extending out of the corresponding slot 1414, such that a remaining portion of each extending portion 1435 which is connected to the surrounding portion 1434 and inserted in the slot 1414 forms the connecting portion 1432, allowing the liquid conductive member 143 to be formed by one sheet of the liquid conductive material 1433.

Figure 9:
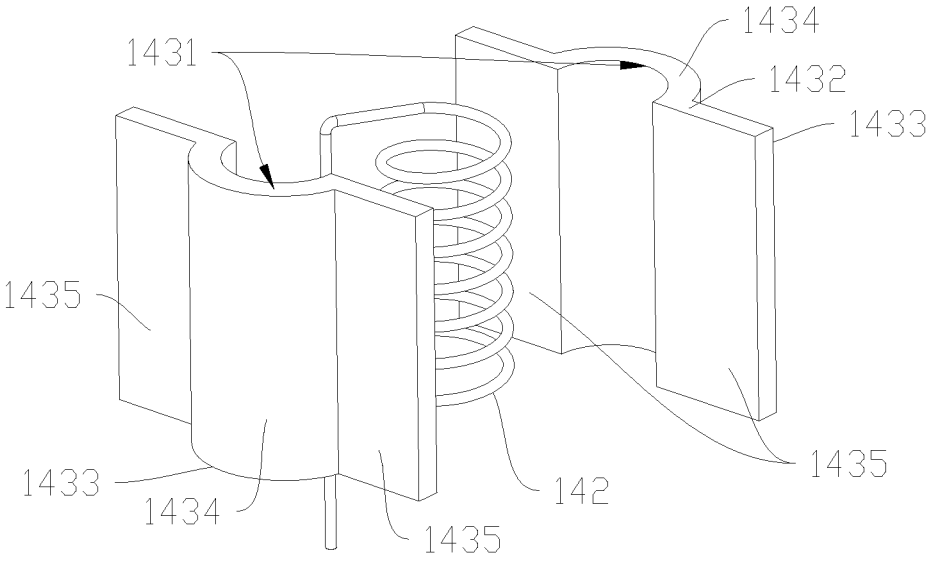
FIG. 9 is a schematic view showing that two sheets of liquid conductive material surround a heating member in accordance with another embodiment of the present disclosure.

As shown in FIG. 9, in other embodiments that the liquid conductive member 143 is formed by two sheets of the liquid conductive material 1433, the method for assembling the atomizer assembly 14 includes steps as follows.

Step A, providing two sheets of the liquid conductive material 1433, wherein each sheet includes a surrounding portion 1434 surrounding the heating member 142 and two extending portions 1435 extending from two opposite sides of the surrounding portion 1434 respectively; clamping the two surrounding portions 1434 of the two sheets of liquid conductive material 1433 onto a side wall of the heating member 142, such that the two extending portions 1435 extend outwards along two opposite lateral directions of the heating member 142, respectively; and surrounding each of the surrounding portions 1434 around the side wall of the heating member 142 such that each of the surrounding portion 1434 is curved to form an arch body and the two arch bodies are circumferentially connected to form the liquid conductive body 1431 to clamp the heating member 142, and each of the connecting portions 1432 contacts the corresponding connecting portion 1432 of the other sheet of liquid conductive material 1433 respectively to keep clamping the heating member 142.

Since the extending portion 1435 is relatively long, during the assembly process of the atomizer device, the two couples of extending portions 1435 can be held by hand such that the heating member 142 is clamped by the liquid conductive body 1431. In other embodiments, the two couples of extending portions 1435 also can be held by a clamper.

Step B, holding the connecting portions 1435 and inserting the liquid conductive body 1431 into the cylindrical body 1412 through the inserting end 1413 such that each couple of the extending portions 1435 are inserted into the corresponding slot 1414.

step C, cutting a portion of each extending portion 1435 extending out of the slot 1414, such that a remaining portion of the extending portion 1435 which is connected to the surrounding portion 1434 and inserted in the slot 1414 forms the connecting portion 1432, allowing the liquid conductive member 143 be formed by the two sheets of liquid conductive material 1433.

After the extending portion 1435 is cut, the atomizer assembly 14, the liquid stopper 144, and the atomizer cover 13 can be assembled together, then the cartridge 111, the suction nozzle 12, and the connection member 15 can be assembled.

The contents described above are only preferred embodiments of the present disclosure, but the scope of the present disclosure is not limited to the embodiments. Any ordinarily skilled in the art would make any modifications or replacements to the embodiments in the scope of the present disclosure, and these modifications or replacements should be included in the scope of the present disclosure. Thus, the scope of the present disclosure should be subjected to the claims.

What is claimed is:

1. An atomizer device, wherein the atomizer device comprises an atomizer assembly (14) having an atomizer base (141), a heating member (142), and a liquid conductive member (143); the atomizer base (141) comprises a cylindrical body (1412) having an inserting end (1413); and a side wall of the cylindrical body (1412) defines at least one slot (1414) extending along a vertical direction and communicating with an end surface of the inserting end (1413); the heating member (142) is cylindrical and arranged in the cylindrical body (1412) along an axial direction of the cylindrical body (1412), and an air flowing channel is defined inside the heating member (142); the liquid conductive member (143) comprises a cylindrical liquid conductive body (1431) and at least one couple of connecting portions (1432) connected together in a circumferential direction of the liquid conductive body (1431); and the liquid conductive body (1431) surrounds the heating member (142), and at least one of the connecting portion (1432) of each couple extends out of the cylindrical body (1412) through the corresponding slot (1414).

2. The atomizer device of claim 1, wherein the connecting portions (1432) of each couple extend out of the cylindrical body (1412) through the corresponding slot (1414).

3. The atomizer device of claim 2, wherein the cylindrical body (1412) defines two of the slots (1414), and the two slots (1414) are symmetrically arranged along a circumferential direction of the cylindrical body (1412).

4. The atomizer device of claim 3, wherein the liquid conductive member (143) comprises two liquid conductive pieces; each of the liquid conductive pieces comprises an arch body and two connecting portions (1432) extending outwards from two circumferential sides of the arch body; the arch bodies of the two liquid conductive pieces are connected to form the liquid conductive body (1431); and two adjacent connecting portions (1432) of the two liquid conductive pieces are connected to form two couples of the connecting portions (1432) corresponding to the slots (1414) respectively.

5. The atomizer device of claim 2, wherein the atomizer device further comprises an atomizer cover (13) and a cartridge (11); the atomizer cover (13) comprises a cylindrical tube (131); a liquid reservoir chamber (113) is formed in the cartridge (11); the cylindrical tube (131) defines at least one liquid inlet (1311) communicating with the liquid reservoir chamber (113), and the atomizer assembly (14) is arranged in the cylindrical tube (131) such that the liquid conductive member (143) can absorb liquid solution flowing into the cylindrical body (1412) through the liquid inlet (1311).

6. The atomizer device of claim 5, wherein the atomizer assembly (14) is arranged inside the cylindrical tube (131) along an axial direction of the cylindrical tube (131); a liquid stopper (144) is arranged between the cylindrical tube (131) and the cylindrical body (1412) for reducing a flowing speed of the liquid solution flowing to the slot (1414) through the liquid inlet (1311).

7. The atomizer device of claim 6, wherein the liquid stopper (144) is cylindrical and surrounds the cylindrical body (1412), the cylindrical tube (131) defines a plurality of the liquid inlets (1311), and the liquid inlets (1311) are arranged along a circumferential direction of the cylindrical tube (131).

8. The atomizer device of claim 2, wherein a guiding portion (1415) is arranged between the slot (1414) and the inserting end (1413) for guiding the connecting portion (1432) to be inserted into the slot (1414).

9. The atomizer device of claim 8, wherein the guiding portion (1415) comprises a chamfered fillet or a chamfered bevel.

10. The atomizer device of claim 2, wherein a guiding surface (1416) is defined in an inner ring of the inserting end (1413) for guiding an insertion of the liquid conductive body (1431).

11. The atomizer device of claim 2, wherein the heating member (142) comprises a spiral cylindrical heating coil or a cylindrical heating tube.

12. The atomizer device of claim 5, wherein the cartridge (11) comprises an outer tube (112) and an inner tube (111), and the liquid reservoir chamber (113) is formed between the inner tube (111) and the outer tube (112); the atomizer cover (13) further comprises an embedded tube (132) arranged on one end of the cylindrical tube (131) and inserted into an inner hole of the inner tube (111); and the embedded tube (132) communicates with the inner tube (111), and an outer wall of the embedded tube (132) is provided with engaging teeth or engaging threads for engaging with an inner wall of the embedded tube (132).

13. An electronic cigarette comprising an atomizer device, wherein the atomizer device comprises an atomizer assembly (14) having an atomizer base (141), a heating member (142), and a liquid conductive member (143); the atomizer base (141) comprises a cylindrical body (1412) having an inserting end (1413); and a side wall of the cylindrical body (1412) defines at least one slot (1414) extending along a vertical direction and communicating with an end surface of the inserting end (1413); the heating member (142) is cylindrical and arranged in the cylindrical body (1412) along an axial direction of the cylindrical body (1412), and an air flowing channel is defined inside the heating member (142); the liquid conductive member (143) comprises a cylindrical liquid conductive body (1431) and at least one couple of connecting portions (1432) connected together in a circumferential direction of the liquid conductive body (1431); and the liquid conductive body (1431) surrounds the heating member (142), and at least one of the connecting portion (1432) of each couple extends out of the cylindrical body (1412) through the corresponding slot (1414).

14. The electronic cigarette of claim 13, wherein the connecting portions (1432) of each couple extend out of the cylindrical body (1412) through the corresponding slot (1414).

15. The electronic cigarette of claim 14, wherein the cylindrical body (1412) defines two of the corresponding slots (1414), and the two corresponding slots (1414) are symmetrically arranged along a circumferential direction of the cylindrical body (1412).

16. The electronic cigarette of claim 15, wherein the liquid conductive member (143) comprises two liquid conductive pieces; each of the liquid conductive pieces comprises an arch body and two connecting portions (1432) extending outwards from two circumferential sides of the arch body; the arch bodies of the two liquid conductive pieces are connected to form the liquid conductive body (1431); and two adjacent connecting portions (1432) of the two liquid conductive pieces are connected to form two couples of the connecting portions (1432) corresponding to the slots (1414) respectively.

17. The electronic cigarette claim 14, wherein the atomizer device further comprises an atomizer cover (13) and a cartridge (11); the atomizer cover (13) comprises a cylindrical tube (131); a liquid reservoir chamber (113) is formed in the cartridge (11); the cylindrical tube (131) defines at least one liquid inlet (1311) communicating with the liquid reservoir chamber (113), and the atomizer assembly (14) is arranged in the cylindrical tube (131) such that the liquid conductive member (143) can absorb liquid solution flowing into the cylindrical body (1412) through the liquid inlet (1311).

18. The electronic cigarette of claim 17, wherein the atomizer assembly (14) is arranged inside the cylindrical tube (131) along an axial direction of the cylindrical tube (131); a liquid stopper (144) is arranged between the cylindrical tube (131) and the cylindrical body (1412) for reducing a flowing speed of the liquid solution flowing to the slot (1414) through the liquid inlet (1311).

* * * * *